US007652437B2

(12) United States Patent
Buij et al.

(10) Patent No.: US 7,652,437 B2
(45) Date of Patent: Jan. 26, 2010

(54) FLUORESCENT TUBE LAMP DRIVE CIRCUIT

(75) Inventors: Arnold Willem Buij, Eindhoven (NL); Geert Willem Van Der Veen, Eindhoven (NL)

(73) Assignee: Koninklije Phillips Electronics, N.V., Eindhoven (NL)

( * ) Notice: Subject to any disclaimer, the term of this patent is extended or adjusted under 35 U.S.C. 154(b) by 580 days.

(21) Appl. No.: 11/570,899

(22) PCT Filed: Jun. 23, 2005

(86) PCT No.: PCT/IB2005/052064

§ 371 (c)(1),
(2), (4) Date: Dec. 19, 2006

(87) PCT Pub. No.: WO2006/003560

PCT Pub. Date: Jan. 12, 2006

(65) Prior Publication Data

US 2008/0303454 A1 Dec. 11, 2008

(30) Foreign Application Priority Data

Jun. 28, 2004 (EP) ..... 04103009

(51) Int. Cl.
*H05B 41/36* (2006.01)

(52) U.S. Cl. ..... 315/307; 315/291; 315/224; 315/209 R; 315/DIG. 5

(58) Field of Classification Search ..... 315/291, 315/307, 224, 225, 209 R, 219, DIG. 4, DIG. 5, 315/DIG. 7; 345/102
See application file for complete search history.

(56) References Cited

U.S. PATENT DOCUMENTS 4,791,338 A 12/1988 Dean et al.
4,952,849 A 8/1990 Fellows et al.
5,111,118 A * 5/1992 Fellows et al. ..... 315/307
5,798,614 A 8/1998 Bishop
5,936,356 A 8/1999 Brault
6,031,342 A 2/2000 Ribarich et al.
6,057,652 A 5/2000 Chen et al.
6,078,147 A 6/2000 Arts et al.
6,285,138 B1 * 9/2001 Kataoka et al. ..... 315/291
6,744,219 B2 * 6/2004 Neidlinger ..... 315/224
2003/0160574 A1 8/2003 Gray

OTHER PUBLICATIONS

International Search Report of International Publication No. PCT/IB2005/052064 Contained in International Publication No. WO2006003560.

Written Opinion of the International Searching Authority for International Application No. PCT/IB2005/052064.

* cited by examiner

*Primary Examiner*—Douglas W Owens
*Assistant Examiner*—Ephrem Alemu

(57) ABSTRACT

A drive circuit for driving a fluorescent tube lamp comprises a variable frequency oscillator generating a lamp drive frequency, a resonant drive circuit driving the lamp with the lamp drive frequency, and a control unit for driving the variable frequency of the latter under control of a synchronization signal. When a pre-heating frequency is generated by the variable frequency oscillator, the lamp is pre-heated while when an illumination drive frequency is generated, the lamp ignites and operates in its illuminated state. The control unit comprises a transition controller for at an ignition of the lamp limiting the drive frequency to an ultimate ignition frequency, and only enabling transition from the ultimate ignition frequency to the illumination drive frequency after an ignition delay time.

11 Claims, 2 Drawing Sheets

FLUORESCENT TUBE LAMP DRIVE CIRCUIT

The invention relates to a drive circuit for driving a fluorescent tube lamp, the drive circuit comprising a variable frequency oscillator for generating a lamp drive frequency, the variable frequency oscillator having a variable frequency oscillator input for setting the lamp drive frequency, a resonant drive circuit connected to a variable frequency oscillator output of the variable frequency oscillator, for driving the lamp with the lamp drive frequency, and a control unit having a synchronization input for receiving a synchronization signal, the control unit for driving the variable frequency oscillator as to under control of the synchronization signal generate a preheating drive frequency for preheating the lamp, or generate an illumination drive frequency for operating the lamp in an illuminated state.

Further, the invention relates to a lamp unit comprising a fluorescent lamp and such a drive circuit. Still further, the invention relates to a liquid crystal display unit comprising a liquid crystal display, a fluorescent lamp for illuminating the liquid crystal display and such a drive circuit for driving the lamp in synchronism with an image refresh rate of the display unit.

Also, the invention relates to a method for driving a fluorescent lamp, the method comprising generating a lamp drive frequency for driving the lamp, driving via a resonant drive circuit the lamp with the lamp drive frequency, receiving a synchronization signal, altering the lamp drive frequency as to under control of the synchronization signal provide a preheating frequency to the lamp for preheating the lamp, or provide an illumination frequency to the lamp for operating the lamp in an illuminated state.

U.S. Pat. No. 4,952,849 describes a fluorescent lamp controller. A fluorescent lamp is driven via a tuned circuit. Before ignition, in a pre-heat phase the resonant circuit is driven with a high frequency. Then, the frequency is lowered and due to the tuned circuit, the lamp voltage increases to sufficient magnitude to ignite the lamp. Upon ignition and as a result of current flow through the lamp, the resonant frequency is reduced from a higher no-load resonance frequency to a lower load-condition resonant frequency.

A problem associated with the circuit according to the state of the art is that lamps, especially in high volume production, will show a certain amount of spread (i.e. tolerance) in characteristics thereof. Some lamps will ignite early, i.e. when decreasing frequency, and thus increasing voltage over the lamp, while other lamps in a same or other production batch take more time to ignite or only ignite at a higher voltage. In case of a lamp which takes more time, e.g. a lamp showing a slower, later ignition, and/or a higher ignition voltage, a drive frequency of the lamp will be decreased by the drive circuit, and hence a voltage over the lamp will more and more increase towards resonance. At the same time, currents flowing through the resonant circuit, and as a result also flowing through switches (such as drive transistors) driving the resonant circuit will also strongly increase, in particular when approaching the resonant frequency before ignition takes place. As a result of this phenomenon, damage could occur to the switches, the resonant circuit or other associated electrical or electronic components due to too high voltages, too high currents, a too high power dissipation or other reasons. In a practical implementation, especially the fact that too high currents will flow through the switches will form a problem.

The invention intends to provide an improved drive circuit taking account of spread in lamp parameters.

To achieve this goal, the drive circuit according to the invention is characterized in that the control unit comprises a transition controller for at a transition from the preheating drive frequency to the illumination drive frequency, limiting the drive frequency to an ultimate ignition frequency, and for only enabling transition from the ultimate ignition frequency to the illumination drive frequency after an ignition delay time. Thus, according to the invention, the drive frequency for driving the lamp via the resonant drive circuit is limited to an ultimate ignition frequency, which advantageously is outside a no-load resonance peak of the resonant drive circuit. As a result thereof, it is prevented that the frequency is changed further, e.g. towards resonance, thus avoiding a further increase in voltages, currents, or other associated quantities hence avoiding a damage or potential long term damage to the drive circuit, variable frequency oscillator, or parts thereof, especially when ignition for a particular lamp shows to be slow. The ultimate ignition frequency will advantageously be chosen such as to achieve a value of a drive voltage driving the lamp, sufficiently high to ignite the lamp. According to the invention, a transition from the ultimate ignition frequency to the illumination drive frequency will only be enabled after an ignition delay time. The ignition delay time may be set at a value which is sufficiently large such that the lamp will have ignited even in a worst case situation and when a relatively slow lamp (within a certain tolerance band) is used with the drive circuit. A fixed value of the delay time may be applied, however it is also possible that the delay time is set by the control unit. To achieve this, the control unit advantageously comprises an ignition sensing means for sensing whether or not ignition has already taken place (this can e.g. be accomplished by monitoring voltage and/or currents in the resonant drive circuit), and upon detection of an ignition, enabling the transmission from the ultimate ignition frequency to the illumination drive frequency, as will be described in more detail below.

A further advantage of the drive circuit according to the invention is that a spread in delay until ignition takes place, i.e. from the moment the frequency starts to change until the moment the lamp ignites, is reduced. To avoid exceeding certain maximum voltages and/or currents in or associated with the resonant circuit, the drive frequency may according to the state of the art only be changed relatively slowly from the pre-heating drive frequency towards the illumination drive frequency. Otherwise, the problems as described above, associated with a late ignition of the lamp will occur too quickly. As a result of the gradual change, a moment in time at which a particular lamp will ignite will show a significant spread due to the spread in ignition characteristics (such as ignition voltage, ignition speed) of the lamps within a batch of lamps. Due to the slow transition of the drive frequency from the pre-heating drive frequency towards the illumination drive frequency, spread in ignition characteristics, in particular a spread in ignition voltage of the lamps will thus translate into a spread in delay from a moment when the transition commences to the moment in time when the particular lamp ignites. Also, tolerances in the variable frequency oscillator and/or the resonant circuit can lead to a spread in ignition moment. Especially in circumstances where multiple lamps are used, or where lamps are operated in a pulse width modulated mode, such a spread in delay time will thus result in a spread in illumination intensity due to the spread in pulse width. According to the invention, it is not required to keep the transition of the drive frequency from the pre-heating drive frequency towards the illumination drive frequency slow before ignition occurs, as the drive frequency is limited to the ultimate drive frequency, which has a safe value avoiding excessive voltages, currents, power dissipation etc. as described above. Thus, the drive frequency can according to the invention be more quickly brought towards the ultimate drive frequency, and as a result thereof spread in ignition characteristics of the lamp (such as a spread in ignition voltage) will hardly translate into a spread in the moment in time at which the particular lamp ignites, making the drive circuit more suitable for use in pulse width modulation applications.

In an advantageous embodiment, the control unit is adapted for gradually in a first frequency changing period changing the frequency of the variable frequency oscillator from the preheating frequency to the ultimate ignition frequency. As described above, the gradual change can take place at a speed of change which is higher than the speed according to the state of the art. In an advantageous, practical implementation, a change from a preheating frequency of 180 kHz to an ultimate ignition frequency of 130 kHz will take place within between 80 and 500 microseconds, more preferably around 100 microseconds which corresponds to around 15 cycle times. In this manner, a too fast change of the drive frequency from the pre-heating drive frequency towards the ultimate ignition frequency is avoided, hence avoiding that the lamp could extinguish after having being ignited, and also avoiding a too quick change of the drive frequency in the resonant circuit which could lead to undesired currents being out of phase, and consequently damages of e.g. the switches driving the resonant circuit.

In an advantageous embodiment the control unit is adapted for gradually changing in a second frequency changing period the frequency of the variable frequency oscillator from the ultimate ignition frequency to the illumination drive frequency. Again, advantages are that current through the lamp will instead of suddenly, be increased gradually, within a time span of several tens of microseconds towards its operational maximum value. In this manner, it is again avoided that the lamp extinguishes due to inappropriate, e.g. too low currents in the lamp just after ignition thereof, or too high currents in the resonant circuit, and hence in the switches driving the resonant circuit due to a too sudden change of the drive frequency on the resonant circuit, which again could result in damaging the switches. In an advantageous, practical embodiment, the time for a transition from the ultimate ignition frequency to the illumination frequency will be in a similar order of magnitude as the transition from the preheating frequency to the ultimate ignition frequency above, i.e. between 80 and 500 microseconds, more preferably around 100 microseconds.

In an advantageous embodiment, the control unit comprises a first circuit for in response to the synchronization signal driving a first frequency determining input of the variable frequency oscillator, and a second circuit for in response to the synchronization signal driving a second frequency determining input of the variable frequency oscillator, the second circuit comprising a delay. In this way, the control unit, and in particular the transition controller thereof, can be implemented in a very simple manner, the first circuit for driving the first frequency determining input, hence taking care of a transition from the pre-heating drive frequency to the ultimate ignition frequency, while after a delay associated with the second circuit the second frequency determining input of the variable frequency oscillator is driven to change the frequency of the variable frequency oscillator from the ultimate ignition frequency towards the illumination drive frequency. In a reliable yet simple to implement and cost effective implementation, the first circuit comprises a voltage limited current source connected to a capacitor for charging the capacitor. The first and second circuit thus derive a drive signal for driving the first, respectively the second frequency determining input, the drive signal being derived from the synchronization signal as provided at the synchronization input.

As described above, the ignition delay time can be fixed or predetermined, however as shortly outlined above it is also possible that the control unit comprises a lamp current measuring circuit for measuring a lamp current, the control unit being adapted for enabling the transition from the ultimate ignition frequency to the illumination drive frequency upon detection of an increase in the lamp current. In this manner, the delay is adapted to meet the lamp characteristics, the transition to the illumination drive frequency is delayed until the moment when the lamp has ignited, this moment being detected by an increase in the lamp current as measured by the current measuring circuit.

In an advantageous embodiment, the control unit comprises the lamp current measuring circuit for measuring the lamp current, the lamp current measuring circuit forming part of a feedback loop to the variable frequency oscillator for adjusting the illumination drive frequency based on the measured lamp current. In this manner, the lamp current, or e.g. an electrical power provided to the lamp can be controlled, as a change in lamp current via the feedback loop may result in an adjustment of the illumination drive frequency, hence changing the lamp drive voltage.

The liquid crystal display unit according to the invention comprises a liquid crystal display, a fluorescent lamp for illuminating the liquid crystal display and a drive circuit according to the invention for driving the lamp in synchronism with an image refresh rate of the display unit. The image refresh rate can e.g. be provided to the drive circuit at the synchronization input thereof.

In an advantageous embodiment, the liquid crystal display according to the invention comprises a plurality of the fluorescent lamps and drive circuits, each drive circuit being operationally connected to one of the lamps for illumination thereof, and a timing circuit having a synchronization input connected to an image refresh rate signal, the timing circuit for in response to the image refresh rate signal cyclically illuminating the lamps in synchronism with the image refresh rate. Especially with such liquid crystal displays, in which a plurality of fluorescent lamps is driven, the advantages of the drive circuit according to the invention are large, as spread in the lamps will according to the invention result in a minimum of spread in the ignition of the lamp (or more correctly speaking: will result in a minimum of spread in the ignition moment of the lamp), while ensuring a reliable operation of the lamps.

The method according to the invention is characterized by the step of limiting the lamp drive frequency at a transition of the preheating frequency to the illumination frequency to an ultimate ignition frequency, and only enabling transition from the ultimate ignition frequency to the illumination frequency after an ignition delay time. With the method according to the invention, similar or identical advantages are achieved as with the drive circuit according to the invention, and similar or identical preferred embodiments can be implemented therewith.

Further features and advantages of the invention will now be described with reference to the appended drawing, showing a non-limiting embodiment of the invention, in which.

Figure 1:
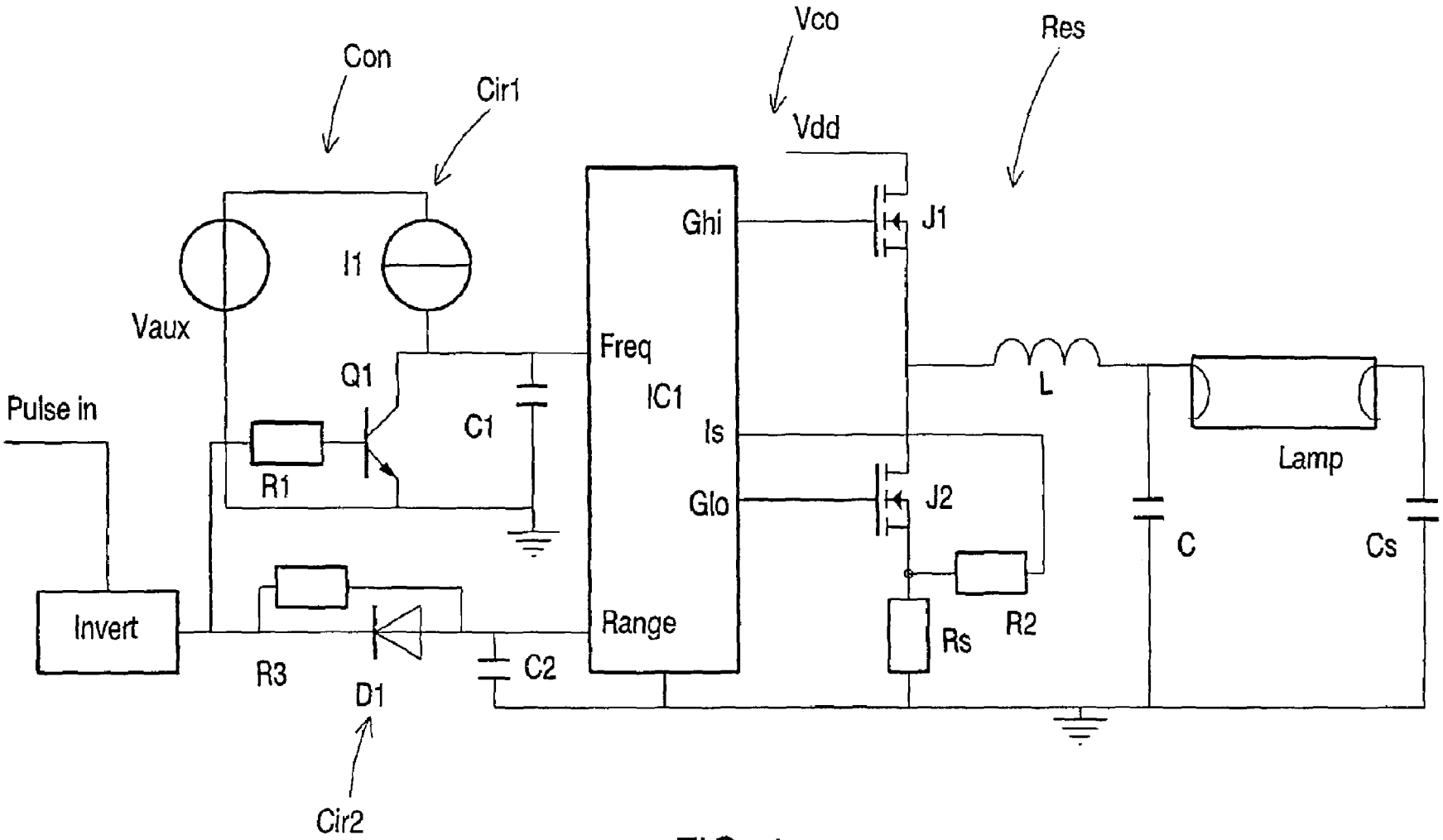
FIG. 1 shows a lamp and a drive circuit according to the invention.

The drive circuit as depicted in FIG. 1 comprises a resonant circuit Res connected to the Lamp, a variable frequency oscillator Vco generating a drive frequency for driving the Lamp via the resonant circuit Res and a control unit Con controlling the variable frequency oscillator Vco. The resonant circuit comprises an inductor L and a capacitor C as depicted in FIG. 1, and a series capacitor Cs connected in series with the lamp. The resonant circuit Res is driven by the variable frequency oscillator Vco, and in particular by switches, such as in this embodiment the output transistors J1 and J2 which are driven by an integrated circuit IC1. The integrated circuit IC1 comprises a frequency determining input Freq which is driven by a first circuit Cir1 and a second frequency determining input Range which is driven by a second circuit Cir2. The first circuit Cir1 and the second Cir2 form part or the control unit Con, in particular of the transition controller thereof. The control unit Con further comprises a synchronization input Pulse in, for receiving a synchronization signal. Not shown in FIG. 1 is an electrode heating circuit being comprised of secondary windings on the coil L, the windings being connected to electrodes of the lamp via a respective coupling capacitor for heating the respective electrode. The operation of the circuit according to FIG. 1 will now be described with reference to FIG. 2.

Figure 2:
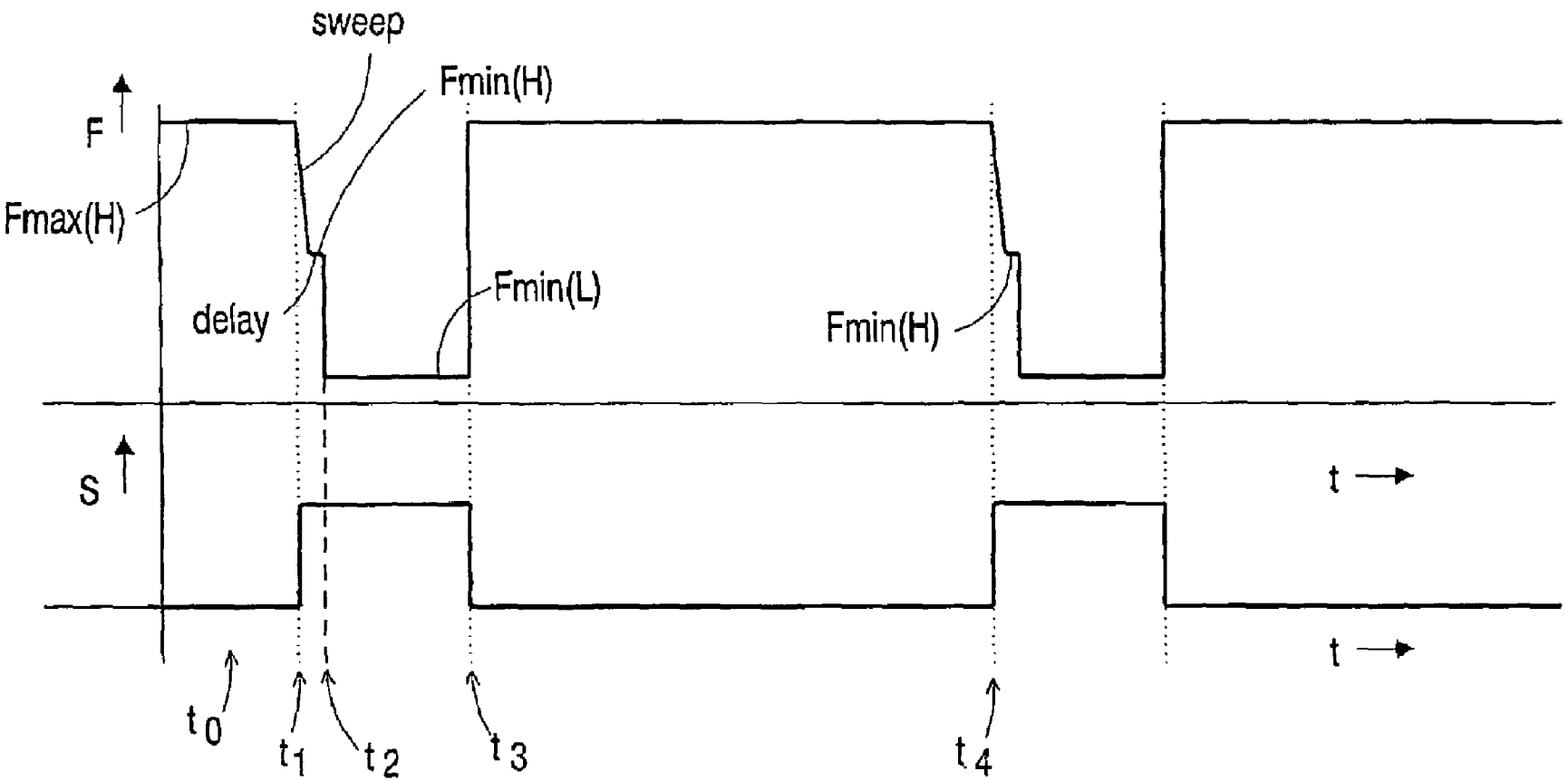
FIG. 2 shows a graphical view of a drive frequency as generated by the drive circuit according to FIG. 1, versus time.

FIG. 2 shows a graph of the lamp drive frequency F as generated by the variable frequency oscillator Vco versus time t, and a graph of an amplitude of the synchronization signal S as provided to the synchronization input Pulse in, versus time t. At the time indicated by $t_0$, the synchronization signal has a low voltage (e.g. 0 volts), which results in a maximum, high frequency Fmax (H) as generated by the variable frequency oscillator Vco. The low value of the synchronization signal at the Pulse in input results in a conduction of the transistor Q1 of the first circuit Cir1 which results in a low value at the input Freq of the integrated circuit IC1 of the variable frequency oscillator Vco. Further, a value at the second frequency determining input Range is high. With the high frequency Fmax (H), the resonant circuit Res will apply a voltage to the lamp sufficiently high to pre-heat the lamp, but below an ignition voltage thereof. As a result thereof, the lamp will be pre-heated but will not illuminate. In fact, during preheating a voltage across the lamp is sufficiently low not to ignite the lamp, however a sufficiently high electrode current is generated in the secondary windings (not shown in FIG. 1) of coil L, the secondary windings each being connected to the electrodes via a coupling capacitor (not shown).

At a moment in time indicated in FIG. 2 by $t_1$, the synchronization signal S moves to its high value. As a result thereof, the transistor Q1 in the first circuit Cir1 will go to its non-conducting state and as a result thereof the current source I1 will gradually charge the capacitor C1. Therefore, a voltage at the input Freq of the integrated circuit IC1 will gradually increase, a slope of increase being determined by a value of the capacitor C1 and the current provided by the current source I1. As a result of the changing voltage at the input Freq, the drive frequency F as generated by the Vco, will change from its maximum value, Fmax (H), i.e. the pre-heating drive frequency, towards the ultimate ignition frequency Fmin (H). A slope of the change, in FIG. 2 indicated by sweep, being determined by the slope of change of the input voltage at the input Freq of the variable frequency oscillator Vco. The voltage at the input Freq is limited by the value of the voltage source Vaux, and as a result thereof a change of the lamp drive frequency F will stop at the ultimate ignition frequency Fmin (H), a value thereof being determined by the value of the voltage source Vaux and a relation between an input voltage at the input Freq and the lamp drive frequency F as generated in response thereto by the variable frequency oscillator Vco. After a certain delay time, a value of an input voltage at the Range input of the variable frequency Vco will exceed a certain value as the resistor R3 charges the capacitor with a time constant determined by values of the respective resistor and capacitor. The Range input of the variable frequency oscillator VCO determines a range of the drive frequency, the value of the voltage at the input Freq determining a value within this range. When the voltage at the Range input exceeds a certain value, the lamp drive frequency will further decrease from the ultimate ignition frequency Fmin (H) to the illumination drive frequency Fmin (L). This change of frequency, which is initiated at the time $t_2$ as indicated in FIG. 2, takes place after a delay, indicated by DELAY in FIG. 2, the delay time being determined by values of the resistor of R3 and the capacitor C2, and is chosen such that the delay time is sufficiently long to be sure that the lamp Lamp, despite spread in its exemplary characteristics, has ignited. In FIG. 2 the change from the ultimate illumination frequency to the illumination drive frequency takes place virtually instantly, however it is also possible that the change takes place gradually, in a manner similar or with a slope similar to the transition from the pre-heating drive frequency to the ultimate ignition frequency.

At a moment in time indicated by $t_3$, the synchronization signal S goes from its high value back to its low value and as a result thereof in the first circuit, the transistor Q1 will go into its conductive state, as a result thereof rapidly discharging capacitor C1, while at the same time the diode D1 in the second circuit Cir2 will rapidly discharge the capacitor C2. As a result thereof both frequency determining inputs, i.e. the input Freq and the input Range, will virtually instantly, or at least with a speed which is an order of magnitude larger than the change of voltage versus time around the times $t_1$, $t_2$. Therefore, the lamp drive frequency will quickly go from the illumination drive frequency Fmin (L) to the pre-heat frequency Fmax (H). As indicated in FIG. 2, this pulse can be repeated, resulting in a periodic ignition and extinguishing of the lamp, at a time indicated by $t_4$ similar occurrences are started in the circuit according to FIG. 1, as are started at $t_1$. A time period between successive ignitions of the lamp is thus determined by a time difference between $t_4$ and $t_1$. The wider the pulses of the synchronization signal S, i.e. the more time $t_3$ moves towards the time $t_4$, the longer the time period the lamp is illuminated. Illumination intensity of the lamp is thus determined by a ratio between the time the lamp is ignited and illuminating, versus the time the lamp is not illuminating and in its pre-heating state.

In some applications, an initial preheating is applied when operation of the lamp starts. Upon starting operation, the lamp is then initially preheated quickly to reach an operational temperature. The periodic preheating during operation as described above (also sometimes referred to as additional heating) is performed with a lower energy than the initial preheating, and is intended to keep the electrodes of the lamp at their operational temperature. In an advantageous embodiment, the initial preheating is performed at a frequency below Fmax(H), to achieve a larger heating power.

The drive circuit can further comprise a lamp current measuring circuit for measuring a lamp current. In that case, the control unit can be adapted for enabling the transition from the ultimate ignition frequency to the illumination drive frequency upon detection of an increase in the lamp current, thus changing to the illumination drive frequency as soon as ignition of the lamp has been detected via the lamp current measuring circuit. Also, the lamp current measuring circuit can form part of a feedback loop to the variable frequency oscillator for adjusting the illumination drive frequency based on the measured lamp current, thus e.g. stabilizing lamp operation, to e.g. achieve a constant lamp current in operation or a constant lamp power.

The drive circuit and lamp according to FIG. 1 can be comprised in a liquid crystal display unit, further comprising a liquid crystal display, the lamp being arranged for illuminating the liquid crystal display. In an advantageous embodiment thereof, the input Pulse in of the control unit Con is provided with a signal in operation indicating an image refresh rate of the liquid crystal display unit. In this manner, the lamp is driven in synchronism with the image refresh rate. Also, a plurality of lamps and associated drive circuits can be comprised in the liquid crystal display unit, advantageously further comprising a timing circuit having a synchronization input connected to an image refresh rate signal, the timing circuit for in response to the image refresh rate signal cyclically illuminating the lamps in synchronism with the image refresh rate of the liquid crystal display unit.

With the drive circuit, display and method according to the invention, the lamp is ignited quickly and reliably, by changing the lamp drive frequency from the pre-heating frequency towards an ultimate ignition frequency, and only enabling transition from the ultimate ignition frequency to the illumination drive frequency after an ignition delay time, ensuring that the lamp has ignited before the frequency is changed from the ultimate ignition frequency to the illumination drive frequency. In this manner, the lamp can be ignited reliably and quickly, without risking damage due to over-voltage or overcurrent in case that the lamp ignites late, while at the same time minimizing spread in delay time upon ignition of the lamp as caused by a spread in ignition voltage of the lamp.

The invention claimed is:

1. A drive circuit for driving a fluorescent tube lamp, the drive circuit comprising:

a variable frequency oscillator for generating a lamp drive frequency, the variable frequency oscillator having a variable frequency oscillator input for setting the lamp drive frequency, a resonant drive circuit, connected to a variable frequency oscillator output of the variable frequency oscillator, for driving the lamp with the lamp drive frequency, and a control unit having a synchronization input for receiving a synchronization signal, the control unit for driving the variable frequency oscillator as to under control of the synchronization signal generate a preheating drive frequency for preheating the lamp, or generate an illumination drive frequency for operating the lamp in an illuminated state, characterized in that the control unit comprises a transition controller for, at a transition from the preheating drive frequency to the illumination drive frequency, limiting the drive frequency to an ultimate ignition frequency, and for only enabling transition from the ultimate ignition frequency to the illumination drive frequency after an ignition delay time.

2. The drive circuit according to claim 1, wherein the control unit is adapted for gradually changing in a first frequency changing period changing the frequency of the variable frequency oscillator from the preheating frequency to the ultimate ignition frequency.

3. The drive circuit according to claim 1, wherein the control unit is adapted for gradually changing in a second frequency changing period the frequency of the variable frequency oscillator from the ultimate ignition frequency to the illumination drive frequency.

4. The drive circuit according to claim 1, wherein the control unit comprises a first circuit for in response to the synchronization signal driving a first frequency determining input of the variable frequency oscillator, and a second circuit for in response to the synchronization signal driving a second frequency determining input of the variable frequency oscillator, the second circuit comprising a delay.

5. The drive circuit according to claim 4, wherein the first circuit comprises a voltage limited current source connected to a capacitor for charging the capacitor.

6. The drive circuit according to claim 1, wherein the control unit comprises a lamp current measuring circuit for measuring a lamp current, the control unit being adapted for enabling the transition from the ultimate ignition frequency to the illumination drive frequency upon detection of an increase in the lamp current.

7. The drive circuit according to claim 1, wherein the control unit comprises the lamp current measuring circuit for measuring the lamp current, the lamp current measuring circuit forming part of a feedback loop to the variable frequency oscillator for adjusting the illumination drive frequency based on the measured lamp current.

8. A lamp unit comprising a fluorescent lamp and a drive circuit according to claim 1.

9. A liquid crystal display unit comprising a liquid crystal display, a fluorescent lamp for illuminating the liquid crystal display and a drive circuit according to claim 1 for driving the lamp in synchronism with an image refresh rate of the display unit.

10. The liquid crystal display according to claim 9, comprising a plurality of the fluorescent lamps and drive circuits, each drive circuit being operationally connected to one of the lamps for illumination thereof, and a timing circuit having a synchronization input connected to an image refresh rate signal, the timing circuit for in response to the image refresh rate signal cyclically illuminating the lamps in synchronism with the image refresh rate.

11. A method for driving a fluorescent lamp, the method comprising:

generating a lamp drive frequency for driving the lamp, driving via a resonant drive circuit the lamp with the lamp drive frequency receiving a synchronization signal, altering the lamp drive frequency as to under control of the synchronization signal provide a preheating frequency to the lamp for preheating the lamp, or provide an illumination frequency to the lamp for operating the lamp in an illuminated state, characterized by the step of limiting the lamp drive frequency at a transition of the preheating frequency to the illumination frequency to an ultimate ignition frequency, and only enabling transition from the ultimate ignition frequency to the illumination frequency after an ignition delay time.

* * * * *